US007585255B1

(12) United States Patent
Chen

(10) Patent No.: US 7,585,255 B1
(45) Date of Patent: Sep. 8, 2009

(54) FOLDING TREADMILL WITH A POSITIONING STRUCTURE

(75) Inventor: Terry Chen, Taoyuan County (TW)

(73) Assignee: Healthstream Taiwan, Inc., Jhongli (TW)

( * ) Notice: Subject to any disclaimer, the term of this patent is extended or adjusted under 35 U.S.C. 154(b) by 0 days.

(21) Appl. No.: 12/252,665

(22) Filed: Oct. 16, 2008

(30) Foreign Application Priority Data

Jul. 15, 2008 (TW) ..... 97212610 U

(51) Int. Cl.
*A63B 22/02* (2006.01)

(52) U.S. Cl. ..... 482/54

(58) Field of Classification Search ..... 482/51, 482/54, 70, 71, 1–9, 52; 403/109.1, 109.3, 403/109.6, 374.5, 324, 325, 327, 328; D21/669
See application file for complete search history.

(56) References Cited

U.S. PATENT DOCUMENTS 5,531,140 A * 7/1996 Chow ..... 81/177.85
6,110,077 A * 8/2000 Yu ..... 482/54
6,139,214 A * 10/2000 Zirps et al. ..... 403/325
6,241,638 B1 * 6/2001 Hurt ..... 482/54
6,273,843 B1 * 8/2001 Lo ..... 482/54
6,692,233 B2 * 2/2004 Liang ..... 416/221
6,913,562 B2 * 7/2005 Chen ..... 482/54
6,979,283 B2 * 12/2005 Pan et al. ..... 482/54
2003/0216226 A1 * 11/2003 Chen ..... 482/54
2004/0176216 A1 * 9/2004 Yu ..... 482/54
2006/0003869 A1 * 1/2006 Huang et al. ..... 482/54
2006/0287162 A1 * 12/2006 Lo ..... 482/54
2007/0191190 A1 * 8/2007 Kuo ..... 482/54
2008/0188358 A1 * 8/2008 Kuo ..... 482/54

FOREIGN PATENT DOCUMENTS

EP 1870137 A1 * 12/2007

* cited by examiner

*Primary Examiner*—Loan H Thanh
*Assistant Examiner*—Daniel F Roland
(74) *Attorney, Agent, or Firm*—Browdy and Neimark, P.L.L.

(57) ABSTRACT

A folding treadmill includes a base frame provided with a stop member, a treadbase pivotally connected to the base frame and selectively set between a horizontal operative position and a vertical non-operative position, and a positioning structure. The positioning structure includes a stop member forced out of the treadbase by a spring member for stopping against the stop member of the base frame so as to hold the treadbase in the non-operative position, a control block operable to move a pull slider to pull the stop member of the positioning structure away from the stop member of the base frame through a link for enabling the treadbase to be turned from the non-operative position to the operative position.

9 Claims, 6 Drawing Sheets

FOLDING TREADMILL WITH A POSITIONING STRUCTURE

BACKGROUND OF THE INVENTION

1. Field of the Invention

The present invention relates to treadmills and more particularly, to a folding treadmill that has a positioning structure for controlling positioning of the treadbase.

2. Description of the Related Art

A conventional folding treadmill generally comprises a base frame for positioning on the floor, a handrail fixedly mounted on and upwardly extending from the base frame, and a treadbase pivotally connected to the base frame and biasable relative to the base frame between a horizontal operative position and a vertical non-operative position. When the folding treadmill is not in use, the user can turn the treadbase upwards relative to the base frame from the horizontal operative position to the vertical non-operative position such that the treadbase can be rested on the handrail to save the storage space.

To avoid falling of the treadbase from the vertical non-operative position, lock means may be provided between the handrail and the treadbase for locking the treadbase in the vertical non-operative position. Alternatively, a retractable support member may be connected between the treadbase and the base frame and controlled by a lever control means or rotary control means to extend or retract, moving the treadbase to the horizontal operative position or the vertical non-operative position. However, the arrangement of the aforesaid lever control means or rotary control means is complicated, not convenient in operation.

SUMMARY OF THE INVENTION

The present invention has been accomplished under the circumstances in view. It is an objective of the present invention to provide a folding treadmill, which allows the user to set the treadbase between the operative position and the folded non-operative position conveniently.

To achieve this objective of the present invention, the folding treadmill is comprised of a base frame, a treadbase and a positioning structure. The base frame is provided with a stop member. The treadbase is pivotally coupled to the base frame and biasable relative to the base frame between a horizontal operative position and a vertical non-operative position. The positioning structure includes a control mechanism, a link and a stop mechanism. The control mechanism has a holder base, a pull slider and a control block. The holder base is fixedly mounted in a rear side of the treadbase. The pull slider, which has a beveled face, is mounted in the holder base and movable by an external force along a first direction. The control block is mounted in the holder base and movable by an external force along a second direction. The control block has a beveled face stopped against the beveled face of the pull slider. The link has a first end connected with the pull slider and a second end connected with the stop member of the stop mechanism. The stop member of the stop mechanism is mounted in a front side of the treadbase. Normally, the stop member extends out of the treadbase. When the treadbase is set in the vertical non-operative position, the stop member of the stop mechanism is stopped against the stop member of the base frame to stop the treadbase in the vertical non-operative position. When the control block is pressed by an external force to move the pull slider, the link is pulled by the pull slider to retract the stop member of the stop mechanism away from the stop member of the base frame for enabling the treadbase to be biased from the vertical non-operative position to the horizontal operative position.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWING

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
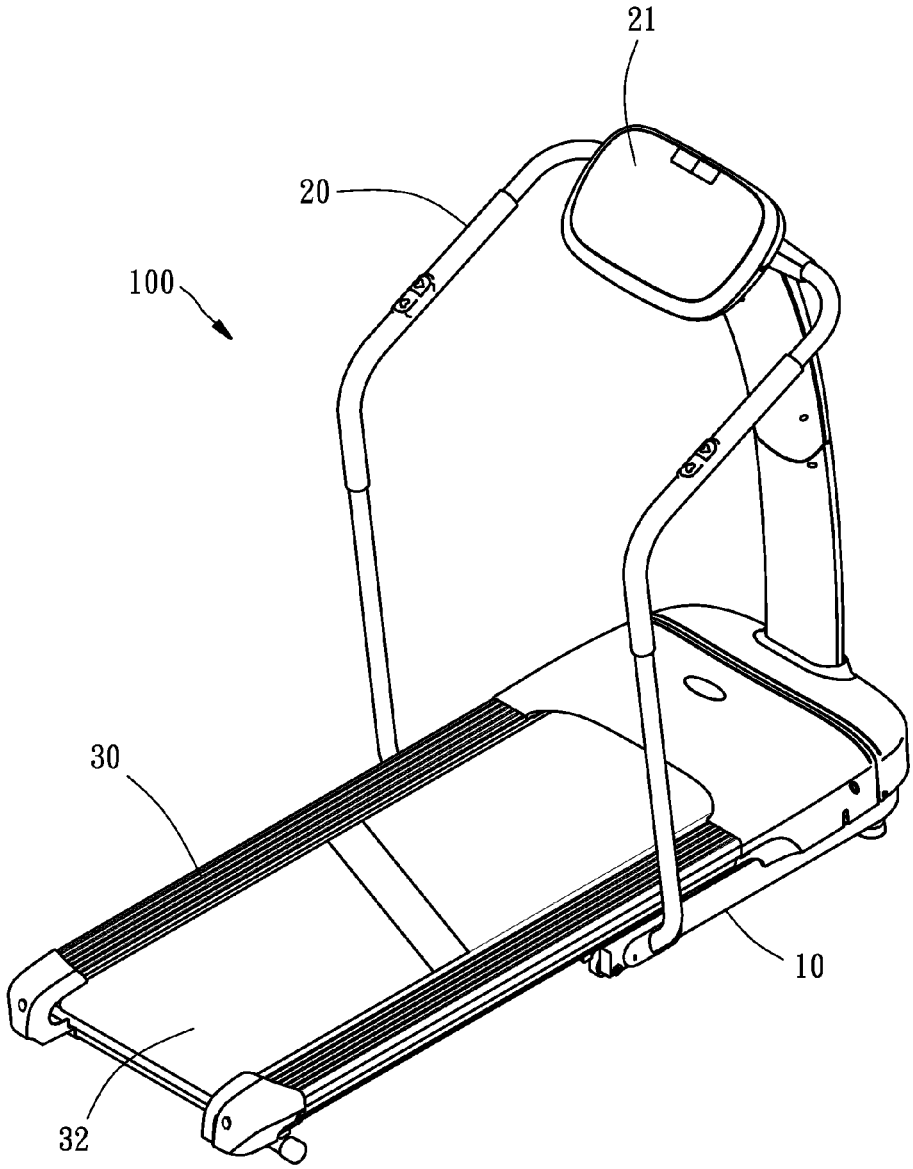
FIG. 1 is a perspective view of a folding treadmill in accordance with a preferred embodiment of the present invention.

Referring to FIGS. 1-6, a folding treadmill 100 in accordance with a preferred embodiment of the present invention is shown comprising a base frame 10, a handrail 20 and a control console 21 mounted on the handrail 20, a treadbase 30, a support bar 40 and a positioning structure 50.

Figure 3:
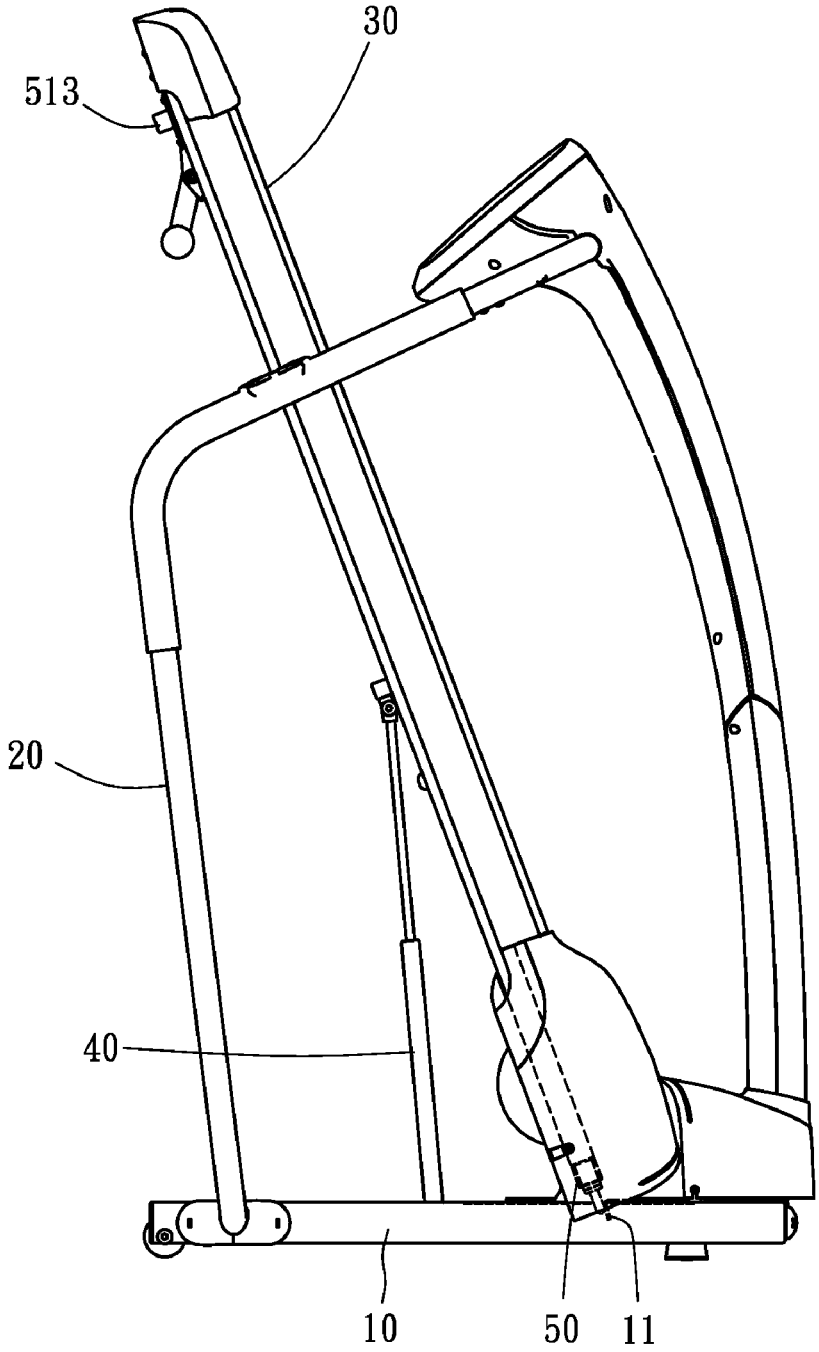
FIG. 3 is another schematic side view of the folding treadmill of the present invention, showing that the treadbase of the treadmill is set in a vertical non-operative position.
Figure 6A:
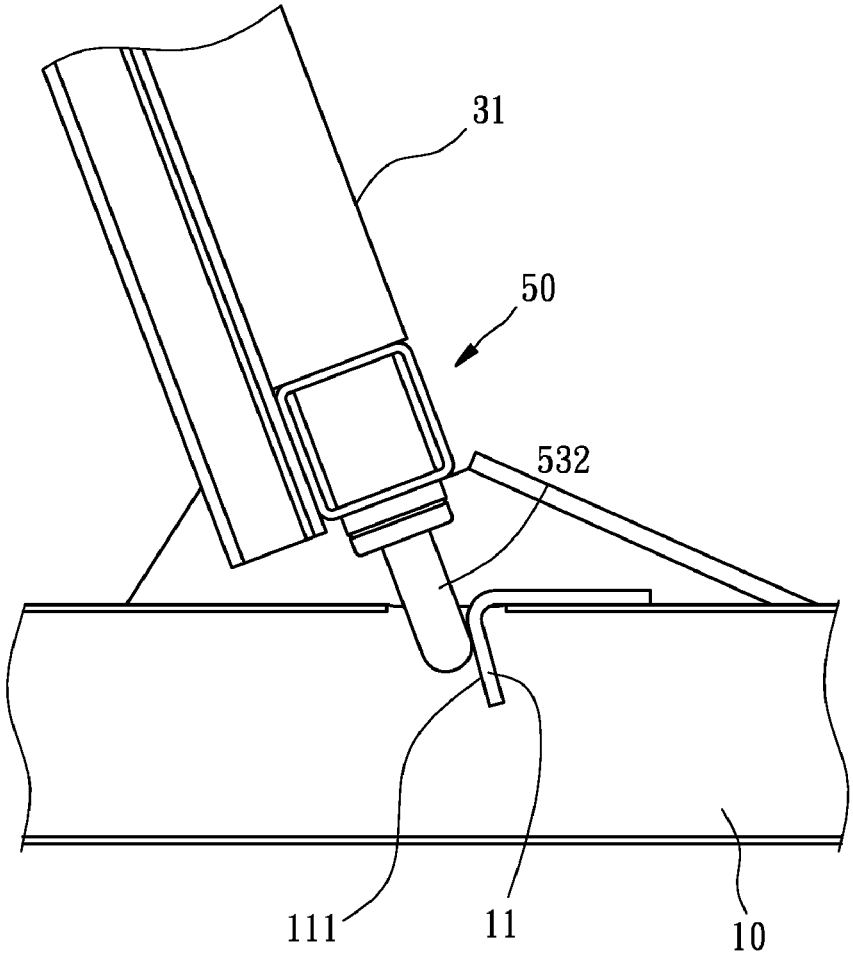
FIG. 6A is a schematic drawing of a part of the folding treadmill of the present invention, showing that the stop member of the stop mechanism is stopped against a stop member at the base frame.

The base frame 10 has opposite left and right frame parts for positioning on the floor stably and a stop member 11 provided at the left frame part. The stop member 11 has a stop face 111 disposed perpendicular to the floor, as shown in FIGS. 3 and 6A.

The handrail 20 is affixed to the front side of the base frame 10 and extends upwards from the base frame 10 for holding by a user's hands.

The treadbase 30 is a rectangular structure having left and right tubular frame bars 31, an endless belt 32 movably trained about rollers (not shown) that are rotatably set in parallel between the front and rear sides of the treadbase 30, and a motor (not shown) mounted in the front side of the treadbase 30 for driving the endless belt 32 to rotate. The front side of the treadbase 30 is pivotally coupled to the base frame 10 so that the treadbase 30 can be alternatively set between a horizontal operating position, as shown FIG. 2, and a vertical non-operative position, as shown in see FIG. 3.

The support bar 40 is a retractable bar formed of, for example, a pneumatic or hydraulic cylinder and operable to adjust the length. The support bar 40 has one end connected to the bottom side of the treadbase 30 and the other end connected to the base frame 10. When the treadbase 30 is lifted from the horizontal operating position toward the vertical non-operative position, the support bar 40 is pulled to extend the length. When the treadbase 30 is set in the vertical non-operative position, the support bar 40 supports the treadbase 30 in the vertical non-operative position, prohibiting the treadbase 30 from falling down. When the treadbase 30 is biased from the vertical non-operative position toward the horizontal operative position, the support bar 40 buffers the speed of the movement of the treadbase 30.

Figure 4:
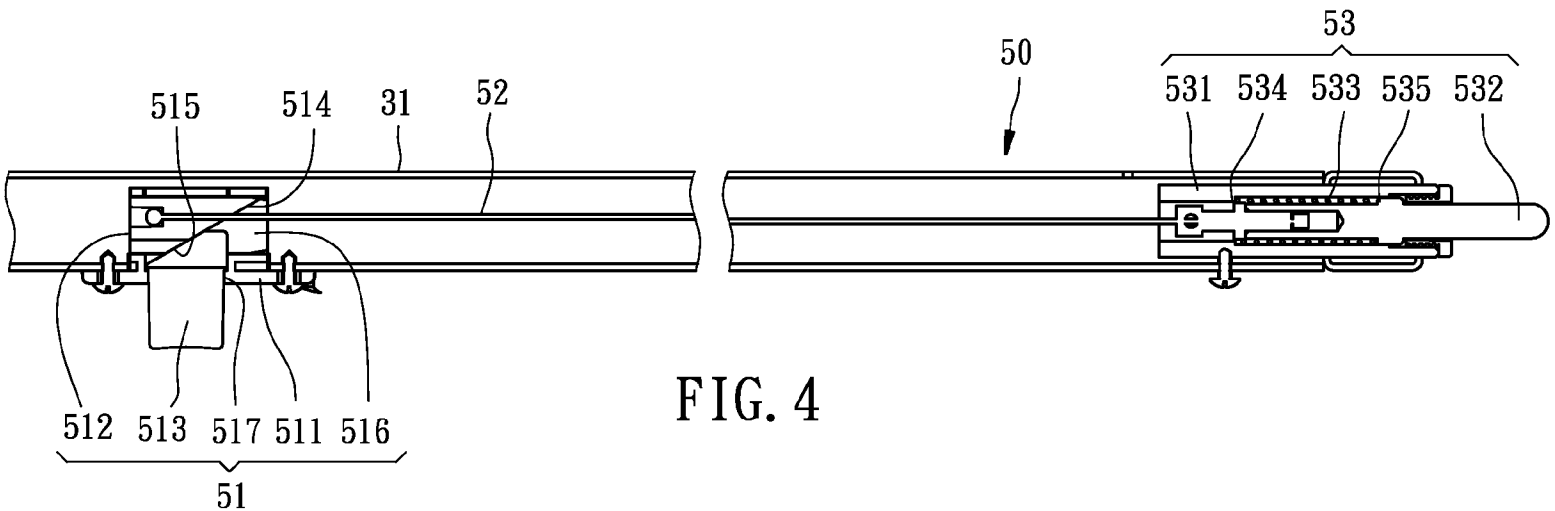
FIG. 4 is a schematic drawing of a part of the folding treadmill of the present invention, showing that a stop member of a stop mechanism of a positioning structure extends out of a tubular guide member.
Figure 5:
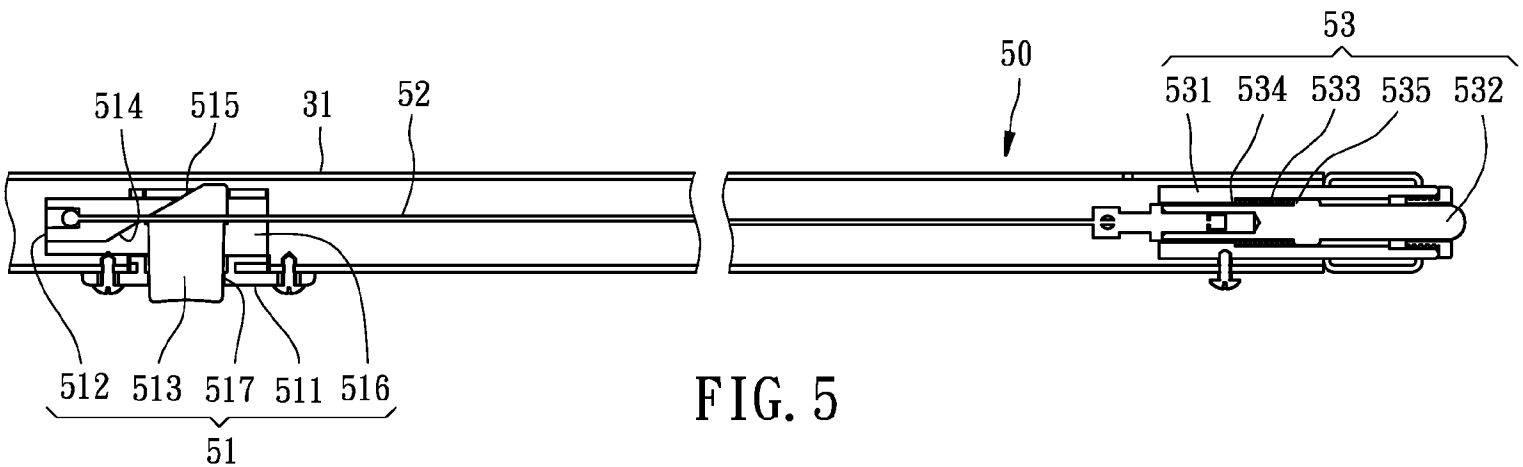
FIG. 5 is similar to FIG. 4 but showing that the stop member of the stop mechanism of the positioning structure is retracted inside the tubular guide member.

The positioning structure 50, as shown in FIGS. 4-6, is installed in the left tubular frame bar 31 of the treadbase 30, and includes a control mechanism 51, a link 52, and a stop mechanism 53.

The control mechanism 51 has a holder base 511, a pull slider 512, and a control block 513. The holder base 511 is affixed to the left tubular frame bar 31 of the treadbase 30 and disposed near the rear side of the treadbase 30, having a sliding passage 516 axially disposed in communication with the axial inside space of the left tubular frame bar 31 of the treadbase 30 and an opening 517 in communication between the sliding passage 516 and the space outside the left tubular frame bar 31 of the treadbase 30. The pull slider 512 is mounted in the sliding passage 516 of the holder base 511 and can be driven by an external force to move in a first direction. According to the present preferred embodiment, the pull slider 512 can be driven to move along the axial direction of the left tubular frame bar 31 of the treadbase 30. Further, the pull slider 512 has a beveled face 514 disposed at one end thereof and sloping at a predetermined angle. The control block 513 is mounted in the opening 517 of the holder base 511 and movable by an external force in a second direction. According to the present preferred embodiment, the control block 513 is movable in a transverse direction relative to the left tubular frame bar 31 of the treadbase 30. Further, the control block 513 has a beveled face 515 stopped against the beveled face 514 of the pull slider 512 in a complementary manner. According to the present preferred embodiment, the aforesaid first direction and second direction are perpendicular to each other; however, this arrangement is just an example but not a limitation.

The link 52 is a steel rope axially inserted into the inside of the left tubular frame bar 31 of the treadbase 30, having one end fixedly connected with the pull slider 512.

The stop mechanism 53 is comprised of a guide member 531, a stop member 532 and a spring member 533. The guide member 531 is a hollow cylindrical member fixedly mounted inside the left tubular frame bar 31 of the treadbase 30 and disposed adjacent to the front side of the treadbase 30, having the axial hole disposed in communication with the axial inside space of the left tubular frame bar 31 of the treadbase 30 and an inside annular flange 534 disposed inside the axial hole. The stop member 532 is a rod member mounted in the axial hole of the guide member 531 and connected with the other end of the link 52 and axially movable along the axial hole of the guide member 531 by the link 52. Further, the stop member 532 has an outside annular flange 535 extending around the periphery thereof. The spring member 533 is sleeved onto the stop member 532 and stopped between the inside annular flange 534 of the guide member 531 and the outside annular flange 535 of the stop member 532 to impart an outward pressure to the stop member 532.

After understanding of the component parts of the folding treadmill 100 and their related mounting arrangement, the operational features of the folding treadmill 100 are outlined hereinafter.

Referring to FIGS. 3, 4 and 6A, when the treadbase 30 is set in the vertical non-operative position, the support bar 40 is stopped between the treadbase 30 and the base frame 10 to hold the treadbase 30 in position and to prohibit the treadbase 30 from falling down. At this time, the stop member 532 is forced out of the guide member 531 by the spring member 533 and stopped against the stop face 111 of the stop member 11, assuring positive positioning of the treadbase 30 in the vertical non-operative position.

Figure 2:
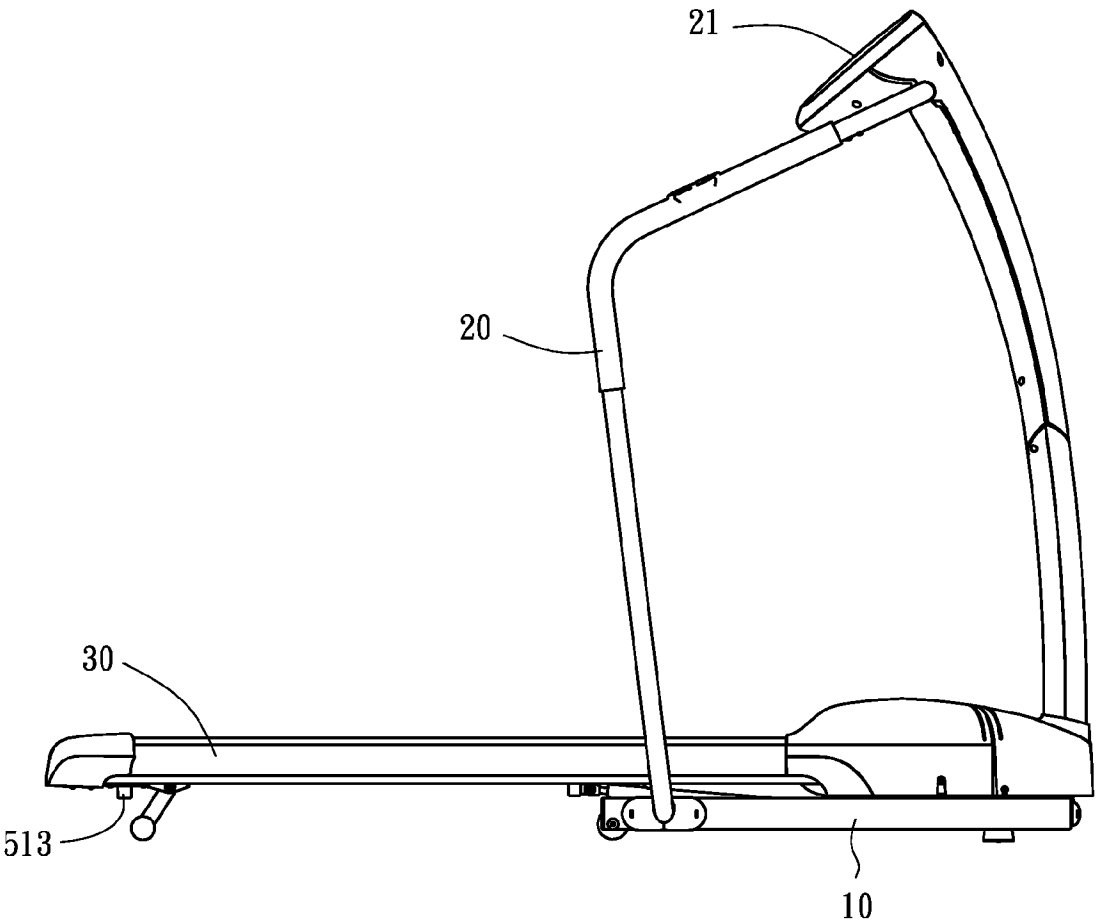
FIG. 2 is a schematic side view of the folding treadmill of the present invention, showing that a treadbase of the treadmill is set in a horizontal operative position.
Figure 6B:
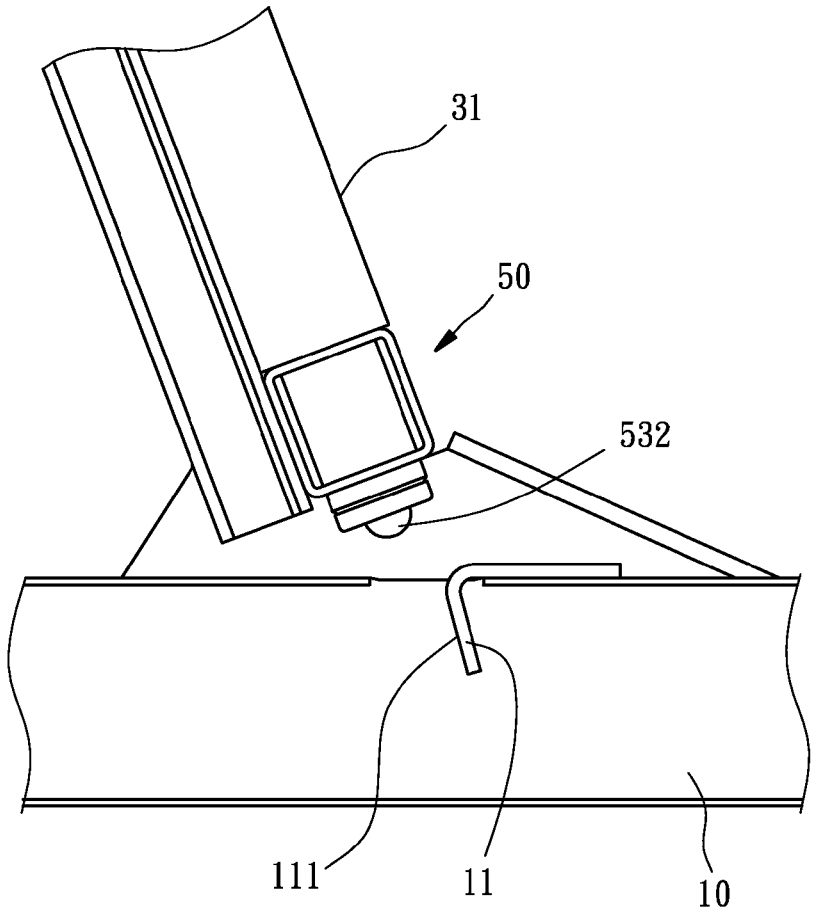
FIG. 6B is similar to FIG. 6A but showing that the stop member of the stop mechanism is retracted in the tubular guide member and spaced away from the stop member at the base frame.

Referring to FIGS. 2, 5 and 6B, when wanting to move the treadbase 30 from the vertical non-operative position to the horizontal operative position, a user can press the control block 513 of the positioning structure 50 to force the beveled face 515 of the control block 513 against the beveled face 514 of the pull slider 512 and to further move the pull slider 512 along the axial direction of the left tubular frame bar 31 of the treadbase 30 toward the rear side of the treadbase 30, causing the link 52 to pull the stop member 532 away from the stop member 11 toward the inside of the guide member 531 and to compress the spring member 533. At this time, the user can bias the treadbase 30 from the vertical non-operative position to the horizontal operative position. When the treadbase 30 reaches the horizontal operative position, the user can then release the hand from the control block 513, enabling the spring member 533 to push the stop member 532 out of the guide member 531.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A folding treadmill comprising:

a base frame for positioning on the floor, said base frame having a stop member;

a treadbase pivotally coupled to said base frame and biasable relative to said base frame between a horizontal operative position and a vertical non-operative position; and a positioning structure including a control mechanism, a link and a stop mechanism, said control mechanism having a holder base, a pull slider and a control block, said holder base being fixedly mounted in a rear side of said treadbase, said pull slider being mounted in said holder base and movable by an external force along a first direction, said pull slider having a beveled face, said control block being mounted in said holder base and movable by an external force along a second direction, said control block having a beveled face abutting against and slidingly movable along the beveled face of said pull slider, said link having a first end connected with said pull slider and a second end, a stop member of said stop mechanism being mounted in a front side of said treadbase and connected with the second end of said link and normally extending out of said treadbase;

wherein when said treadbase is set in said vertical non-operative position, the stop member of said stop mechanism is stopped against the stop member of said base frame to stop said treadbase in said vertical non-operative position; when said control block is pressed by an external force to move said pull slider, said link is pulled by said pull slider to retract the stop member of said stop mechanism away from the stop member of said base frame for enabling said treadbase to be biased from said vertical non-operative position to said horizontal operative position.

2. The folding treadmill as claimed in claim 1, further comprising a retractable support bar that has one end thereof connected to a bottom side of said treadbase and an opposite end thereof connected to said base frame.

3. The folding treadmill as claimed in claim 1, wherein said treadbase comprises a left tubular frame bar and a right tubular frame bar respectively disposed at two opposite lateral sides thereof; said positioning structure is installed in said left tubular frame bar.

4. The folding treadmill as claimed in claim 3, wherein said holder base of said control mechanism comprises a sliding passage axially disposed in communication with an axial inside space of said left tubular bar, and an opening in communication between said sliding passage and a space outside said left tubular frame bar; said pull slider is slidably mounted in said slide passage; said control block is movably mounted in said opening.

5. The folding treadmill as claimed in claim 3, wherein said link is a steel rope inserted in said tubular left frame bar.

6. The folding treadmill as claimed in claim 1, wherein said stop mechanism of said positioning structure further comprises a guide member affixed to said front side of said treadbase and provided with an axial hole, an inside annular flange disposed inside said axial hole, and a spring member; wherein the stop member of said stop mechanism is mounted in said axial hole of said guide member and movable with said link along said axial hole; wherein the stop member of said stop mechanism has an outside annular flange; wherein the spring member is sleeved onto the stop member of said stop mechanism and stopped between said inside annular flange and said outside annular flange.

7. The folding treadmill as claimed in claim 3, wherein said stop mechanism of said positioning structure further comprises a guide member flixedly mounted inside said left tubular frame bar of said treadbase and provided with an axial hole in communication with an axial inside space of said left tubular frame bar, an inside annular flange disposed inside said axial hole, and a spring member; wherein the stop member of said stop mechanism is mounted in said axial hole of said guide member and movable with said link along said axial hole; wherein the stop member of said stop mechanism has an outside annular flange; wherein the spring member is sleeved onto the top member of said stop mechanism and stopped between said inside annular flange and said outside annular flange.

8. The folding treadmill as claimed in claim 1, wherein said first direction and said second direction extend perpendicular to each other.

9. The folding treadmill as claimed in claim 1, wherein the beveled face of said pull slider and the beveled face of said control block are complementary to each other.

* * * * *